US005091754A

United States Patent [19]

Abe et al.

[11] Patent Number: 5,091,754

[45] Date of Patent: Feb. 25, 1992

[54] IMAGE FORMING APPARATUS COMPRISING LATERAL MOVEMENT MEANS

[75] Inventors: Makoto Abe, Kashiwa; Junichi Kimizuka, Yokohama; Akihisa Kusano, Kawasaki; Kaoru Sato, Yokohama; Toshiyuki Ito, Sagamihara; Kazuhiko Okazawa, Kawasaki; Toshihiko Inuyama, Fujisawa; Takahiro Azeta, Kawasaki; Yoshiro Tsuchiya, Yokohama; Hiroshi Yukimachi, Kawasaki; Tadashi Yagi, Machida; Hiroo Kobayashi, Tokyo; Masahito Otsuka, Kawasaki; Tsuyoshi Waragai, Tokyo; Takamasa Sawada, Kawasaki; Hiroaki Miyake, Yokohama; Toshifumi Moritani, Yokohama, all of Japan

[73] Assignee: Canon Kabushiki Kaisha, Tokyo, Japan

[21] Appl. No.: 514,310

[22] Filed: Apr. 25, 1990

[30] Foreign Application Priority Data

| | | | |
|---|---|---|---|
| Apr. 26, 1989 | [JP] | Japan | 1-106611 |
| Apr. 28, 1989 | [JP] | Japan | 1-111037 |
| Jul. 31, 1989 | [JP] | Japan | 1-199018 |

[51] Int. Cl.[5] ..... G03G 21/00

[52] U.S. Cl. ..... 355/317; 355/308; 355/311; 271/188; 271/209; 271/234; 271/240

[58] Field of Search ..... 355/308, 309, 311, 317, 355/318, 319, 321, 206, 209, 23–26; 271/184–186, 188, 209, 225, 234, 240

[56] References Cited

U.S. PATENT DOCUMENTS

| | | | |
|---|---|---|---|
| 3,649,005 | 3/1972 | Miller et al. | 271/240 |
| 4,685,793 | 8/1987 | Sawada et al. . | |
| 4,849,796 | 7/1989 | Murakami | 355/206 |
| 4,874,160 | 10/1989 | Yamamoto | 271/240 X |
| 4,935,786 | 6/1990 | Veeder | 355/319 |
| 4,949,134 | 8/1990 | Iwaki et al. | 271/240 X |
| 4,953,846 | 9/1990 | Azeta et al. . | |

FOREIGN PATENT DOCUMENTS

| | | | |
|---|---|---|---|
| 0047659 | 4/1979 | Japan | 355/319 |

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

This invention relates to an image forming apparatus having a convey path comprising lateral movement apparatus for controlling a widthwise position of a sheet member to be conveyed, wherein the lateral movement apparatus is curved in a convey direction.

20 Claims, 13 Drawing Sheets

IMAGE FORMING APPARATUS COMPRISING LATERAL MOVEMENT MEANS

BACKGROUND OF THE INVENTION

1. Field of the Invention

The present invention relates to an image forming apparatus comprising a lateral movement means, e.g., an image forming apparatus such as a copying machine, a laser beam printer, or the like and, more particularly, to an image forming apparatus having a convey path which can control a widthwise position of a recording member (or sheet member) to be conveyed.

2. Related Background Art

As a means for controlling a widthwise position of a sheet member in a convey path of a conventional image forming apparatus (to be referred to as "lateral registration" hereinafter), as shown in FIGS. 1A and 1B, a sheet member (paper) P is urged against a lateral regist plate 51 serving as a reference plate by a compression spring 53 through a lateral regist plate 52, thereby achieving lateral registration.

Since the transfer paper P is pressed by the compression spring 53, however, when the pressing force of the compression spring 53 exceeds a hardness to bend of the transfer paper P, the transfer paper P is conveyed while being bent or wrinkled, as shown in FIG. 1B. As a result, lateral misregistration easily occurs.

SUMMARY OF THE INVENTION

It is therefore an object of the present invention to provide an image forming apparatus in which a convey path corresponding to a portion for controlling the widthwise position of a sheet member to be conveyed is curved in a convey direction, thereby allowing stable lateral registration.

In order to achieve the above object, according to the present invention, an image forming apparatus having a convey path comprising control means for controlling a widthwise position of a sheet member to be conveyed is characterized in that the convey path comprising the control means is curved in a convey direction of the sheet member. The control means is a lateral movement mechanism for pressing the sheet member in a widthwise direction.

According to the present invention, the widthwise position of the sheet member is controlled by the control means on the convey path which is curved in the convey direction of the sheet member. Since the sheet member is curved in the convey direction, widthwise hardness to bend of the sheet member is enhanced. Therefore, when the sheet member receives a widthwise control force by the control means, it can be prevented from being wrinkled, bent, or crushed, and can be conveyed while its widthwise position can be stably controlled. Therefore, the sheet member can be prevented from jamming.

DESCRIPTION OF THE PREFERRED EMBODIMENTS

An embodiment of the present invention will be described below with reference to FIGS. 2 to 7.

Figure 1A:
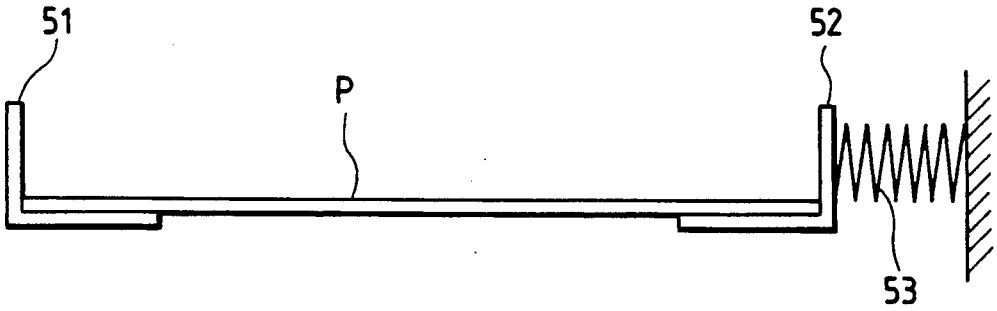
FIG. 1A PRIOR ART
FIGS. 1A and 1B are sectional views showing a conventional widthwise position controlling state of a sheet member.
Figure 1B:
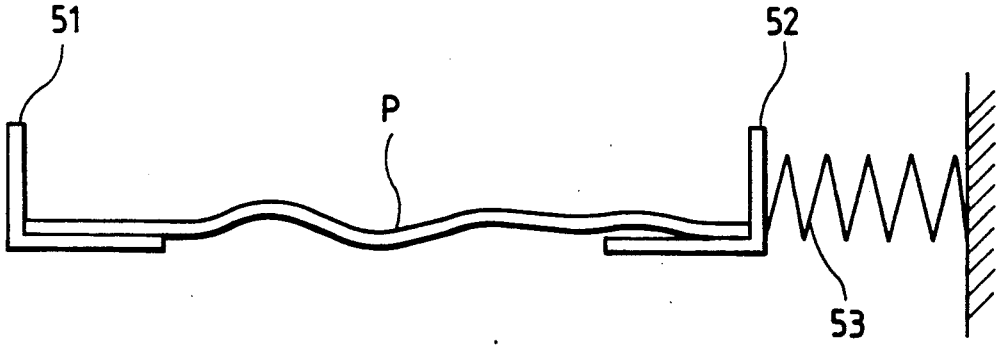
Figure 2:
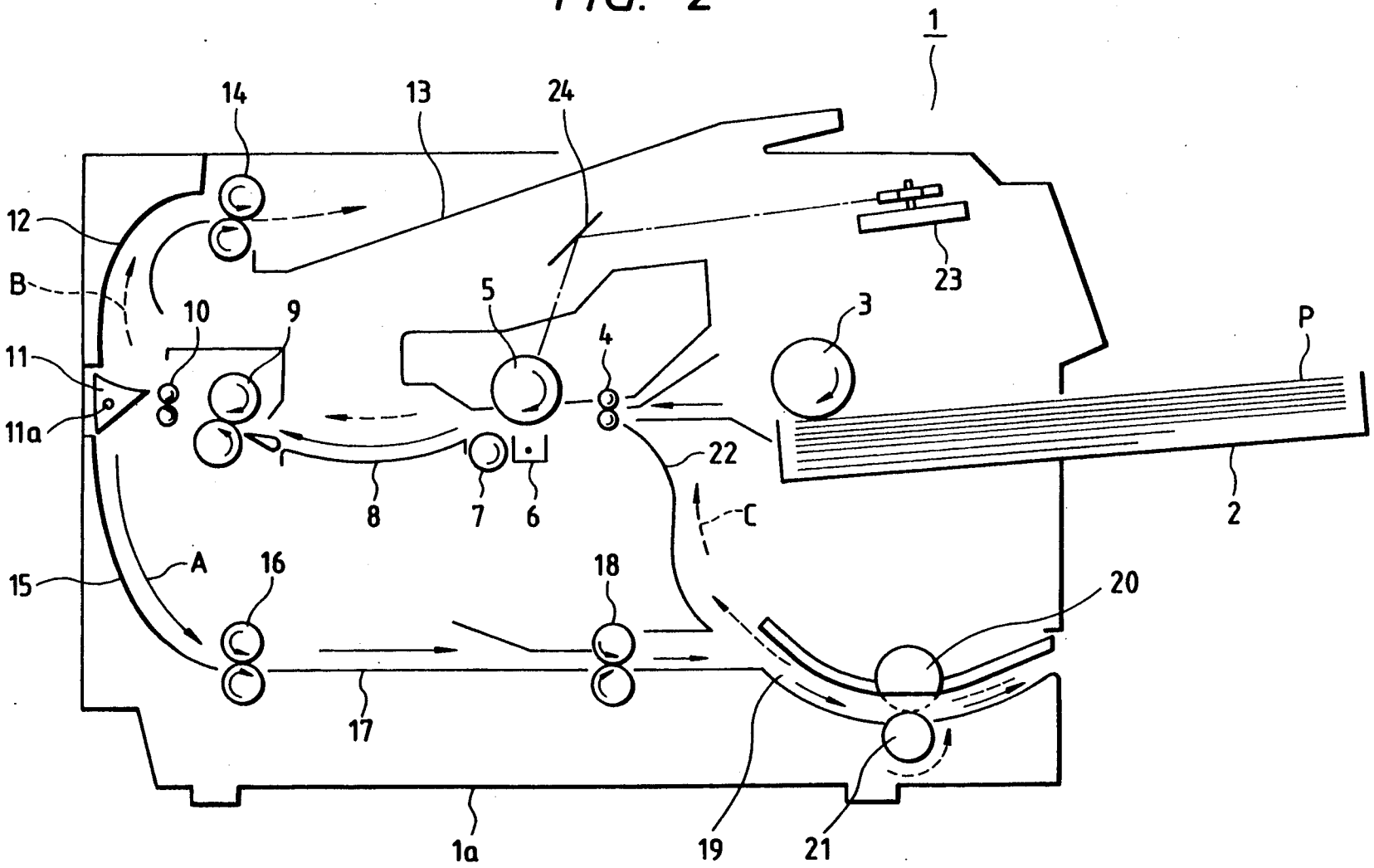
FIG. 2 is a side sectional view showing the overall embodiment of the present invention.
Figure 3:
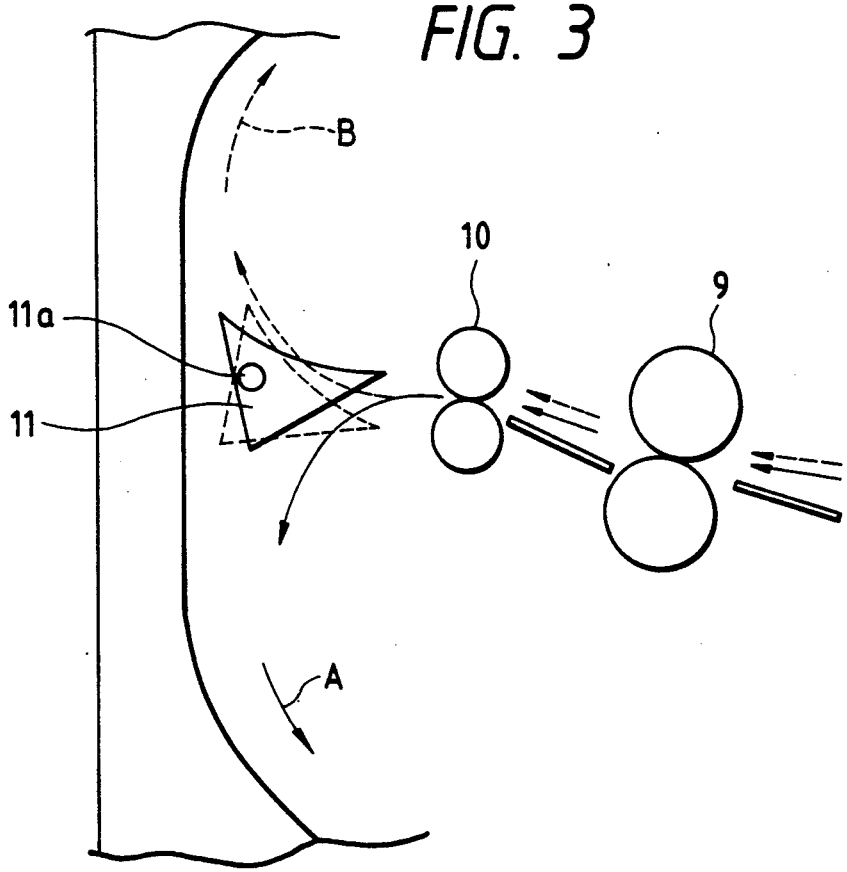
FIG. 3 is a side sectional view of a flapper switched for recording on the second surface.

FIG. 2 shows a laser beam printer 1. A cassette 2 storing sheet members P is inserted and set in the right wall of the printer 1. The printer 1 includes a sheet supply roller 3, regist rollers 4, a photosensitive drum 5, a transfer charger 6, a convey roller 7, a convey unit 8 comprising a conveyor, a pair of fixing rollers 9, convey rollers 10, and a flapper 11 axially supported on a shaft 11*a*. A guide 12 is arranged above the flapper 11. The end portion of the guide 12 is open to a tray 13 arranged on the upper surface of a main body 1*a*, and exhaust rollers 14 are arranged at this end portion.

A guide 15 is arranged to extend below the flapper 11. Convey rollers 16 are arranged at the end portion of the guide 15, and convey rollers 18 are arranged at a downstream portion of a horizontal guide 17 following the guide 15.

Figure 5A:
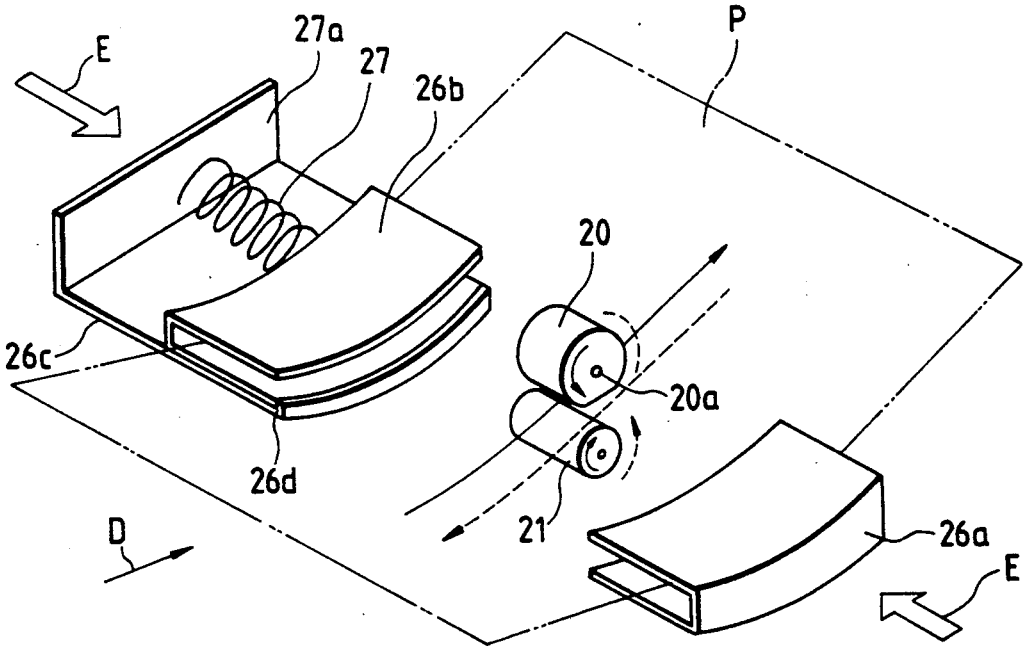
FIG. 5A is a perspective view of a widthwise position control means of a sheet member.
Figure 5B:
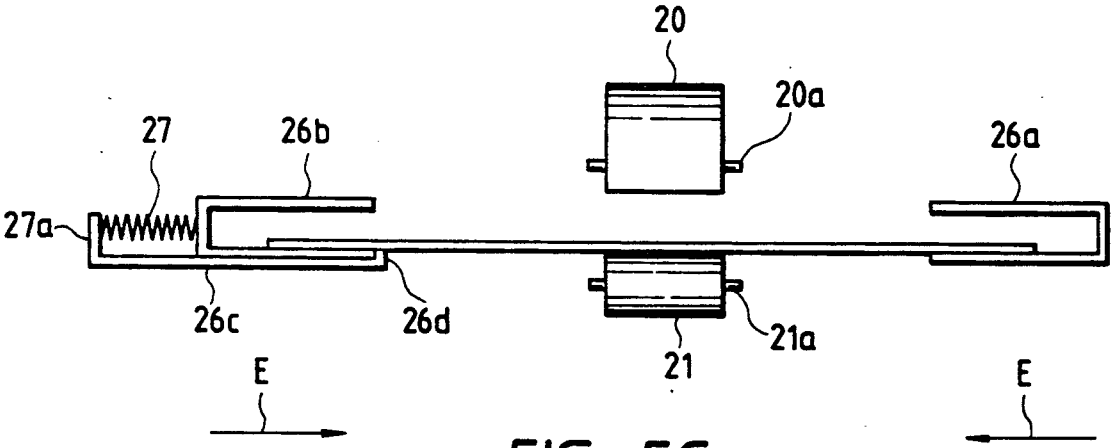
FIG. 5B is a front sectional view of the widthwise position control means.
Figure 5C:
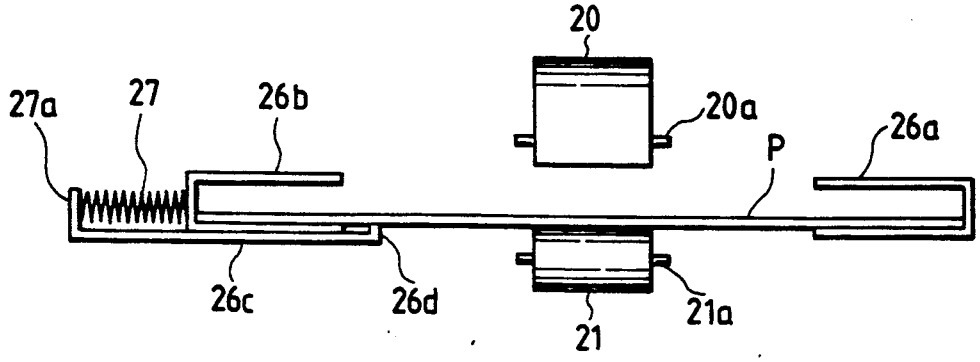
FIG. 5C is a front sectional view showing a sheet member controlling state of the widthwise position control means.

A guide 19 which is curved upward extends from the end portion of the horizontal guide 17 through the right wall of the main body 1*a*. The guide 19 has a U-shaped section, as shown in FIGS. 5A, 5B, and 5C, and its opening portion is defined by opposing lateral regist plates 26*a* and 26*b*. The shape of the guide 19 conforms not to that of the guide 17, but to that of a guide 22. A semi-circular roller 20, which can be rotated in both normal and reverse directions, is arranged between the lateral regist plates 26*a* and 26*b*, and a rotatable roller 21 is arranged to oppose the roller 20. The guide 22 which is curved upward extends from the guide 19 to the regist rollers 4. A light beam scanned by a polygonal scanner 23 is guided to the photosensitive drum 5 by a mirror 24.

Figure 4:
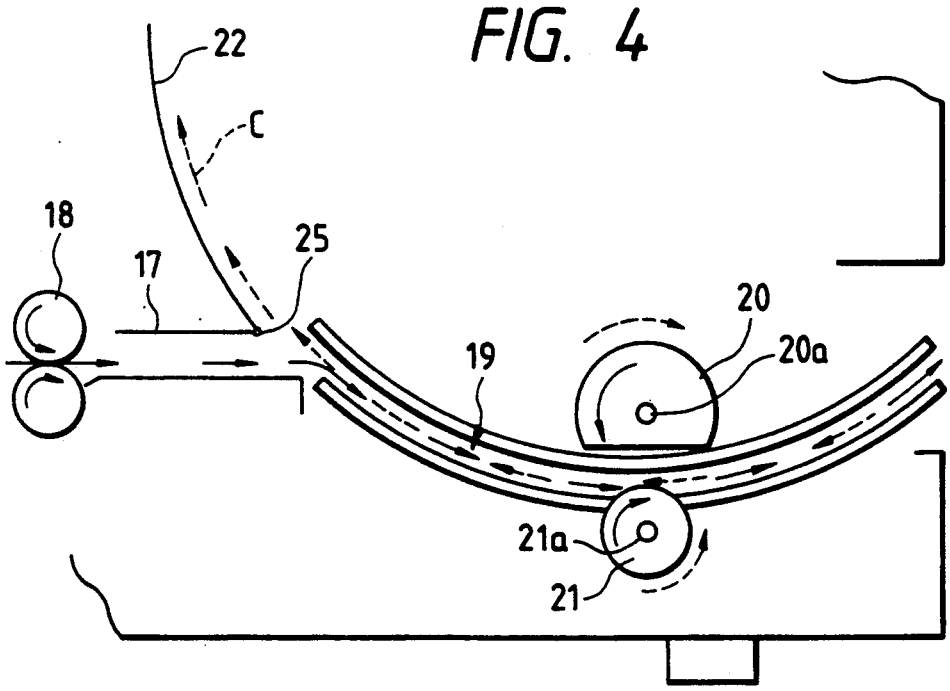
FIG. 4 is a side sectional view of a portion for controlling a widthwise position of a sheet member.

As shown in FIG. 4, the semi-circular roller 20 is driven by a shaft 20*a*, and the driven roller 21 is axially supported by a shaft 21*a*. The guides 22 and 17 define an edge 25.

In FIGS. 5A to 5C, as described above, the lateral regist plates 26*a* and 26*b* are arranged to oppose each other. The lateral regist plate 26*b* is slidably arranged on a base plate 26*c*. The base plate 26*c* has a stopper 26*d* for inwardly stopping the lateral regist plate 26*b* on its inner edge, and has a spring base 27*a* on its outer side. The lateral regist plate 26*a* and the base plate 26*c* are moved inwardly by a driving source (not shown; for converting rotation into a linear movement by means of a motor, and a pinion and a rack (see FIG. 9 for further details of the driving source)). A compression spring 27 is interposed between the spring base 27*a* and the lateral regist plate 26*b*.

The operation of this embodiment will be described below.

A sheet member P supplied from the cassette 2 by the sheet supply roller 3 is conveyed by the regist rollers 4 in synchronism with the timing of the photosensitive drum 5, and an image formed on the photosensitive drum 5 is transferred onto the sheet member P. The image transferred onto the sheet member P is fixed by the pair of fixing rollers 9 via the convey unit 8. The sheet member P is then guided by the convey rollers 9 to the flapper 11.

When images are printed on two surfaces of the sheet member P, the sheet member P on the first surface of which an image is printed is conveyed in a direction of an arrow A by the flapper 11 at a solid line position in FIG. 2, and is then guided toward guides 19*a* and 19*b* by the convey rollers 16 and 18.

The guide 19 comprises the lateral regist plates 26*a* and 26*b* having a U-shaped section and located to define an opening larger than the width of the sheet member P, as shown in FIG. 5A. The sheet member P enters a gap between the lateral regist plates 26*a* and 26*b*. The semi-circular roller 20 stands by with its cut portion facing down, and the leading end portion of the sheet member P is inserted in a gap between the rollers 20 and 21. The rollers 20 and 21 are rotated once in a direction of a solid arrow to convey the sheet member P in a direction of an arrow D until its trailing end passes by the edge 25 (FIG. 4). The roller 20 is stopped with its cut portion facing down again. In this state, the sheet member P is curved along the curvature of the lateral regist plates 26*a* and 26*b* to enhance lateral hardness to bend, and is fixed in position in a free state.

In this case, the lateral regist plate 26*a* and the base plate 26*c* are moved by the driving source (not shown) in a direction of an arrow E (inward) shown in FIGS. 5A and 5B, and the lateral regist plate 26*a* is stopped at a reference position (since this embodiment adopts a central reference system, the reference position is selected according to a sheet size information). The lateral regist plate 26*b* clamps the sheet member P by the biasing force of the compression spring 27, as shown in FIG. 5C, thereby laterally registering the sheet member P. In this case, since the sheet member P is curved by the guide 19 to enhance its hardness to bend, it can be prevented from being crushed.

The roller 20 is then rotated in a direction of a broken arrow in FIG. 5A to switch back the sheet member P and to smoothly convey it onto the guide 22 in a direction of an arrow C in FIG. 4. In this case, a convey force for switching back the curved sheet member P is larger than that required when the sheet member is loaded. The second surface of the sheet member P is conveyed to the regist rollers 4 in the same state as the first surface described above. After the sheet member P is subjected to image transfer and fixing, the flapper 11 is set at the position indicated by a broken line in FIG. 3. Thus, the sheet member P is conveyed in a direction of an arrow B and is exhausted onto the exhaust tray 13.

As described above, since the sheet member P is conveyed on the guide 22 after it is curved by the lateral regist plates 26*a* and 26*b*, the curved sheet member P ca be smoothly conveyed along the guide 22 which is curved in the same direction as the sheet member, and the laterally registered sheet member will not be misregistered. No flapper is required at the edge 25.

Figure 6A:
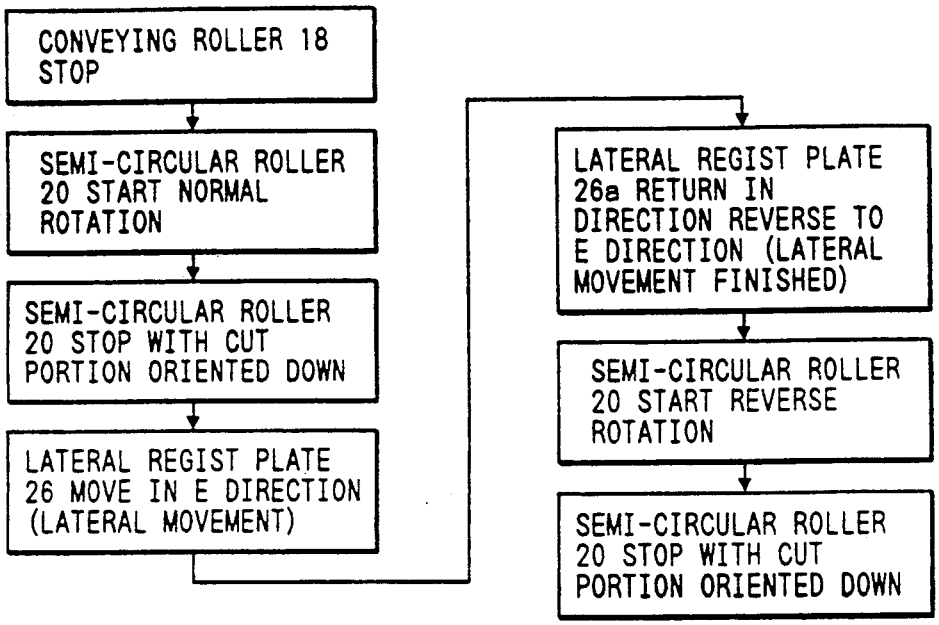
FIG. 6A is an operation block diagram of a semi-circular roller and a lateral regist plate.
Figure 6B:
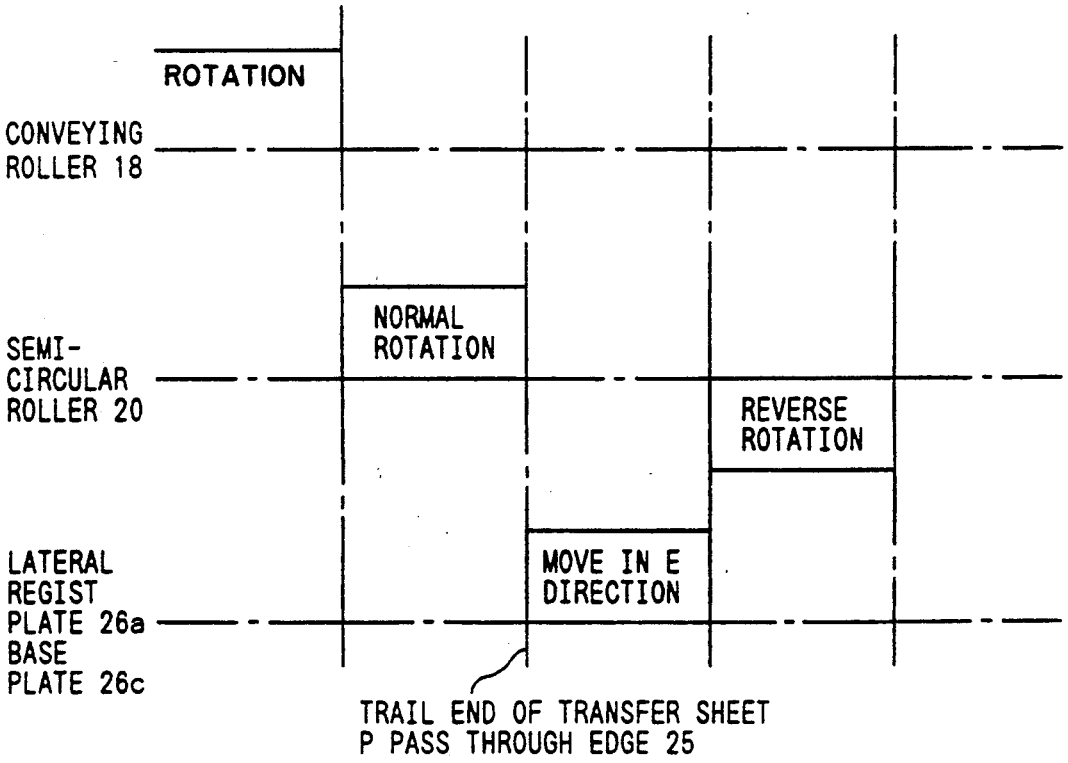
FIG. 6B is a timing chart of FIG. 6A.

The operations of the semi-circular roller 20, the lateral regist plate 26*a*, and the base plate 26*c* described above can be expressed as the block diagram of FIG. 6A and the timing chart of FIG. 6B.

As described above, since the sheet member P is curved in a convey direction on a portion for performing lateral registration, the hardness to bend in the widthwise direction of the sheet member P can be enhanced, and the sheet member P can be prevented from being bent, wrinkled, or crushed by the pressing force of the compression spring 27. As a result, stable lateral registration and conveyance of the sheet member P can be attained.

Figure 7:
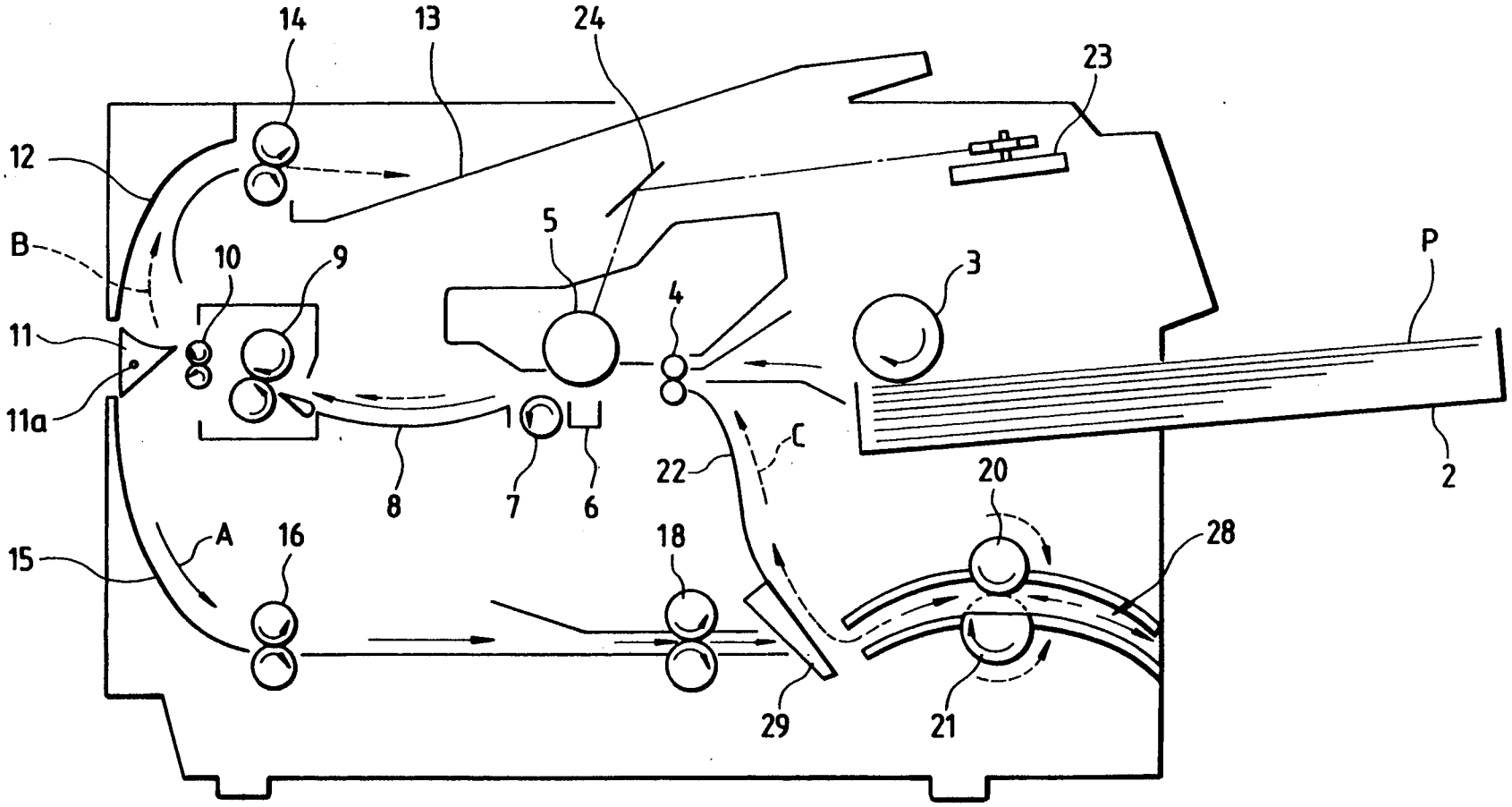
FIG. 7 is a side sectional view showing another embodiment of the present invention.

Another embodiment will be described below with reference to FIG. 7.

The same reference numerals denote parts having the same arrangements and operations, and a detailed description, and a detailed description thereof will be omitted.

In this embodiment, a guide 28 is curved upward in a convex shape unlike in the above embodiment. Therefore, since a direction reversed from this guide 28 cannot match with the guide 22, a flapper 29 is arranged to match them. The flapper 29 is pressed by a sheet member and is turned to the left, thereby guiding the sheet member from the rollers 18 to the guide 28.

This arrangement enhances hardness to bend of the sheet member P and provides other associated effects as described above.

Figure 8:
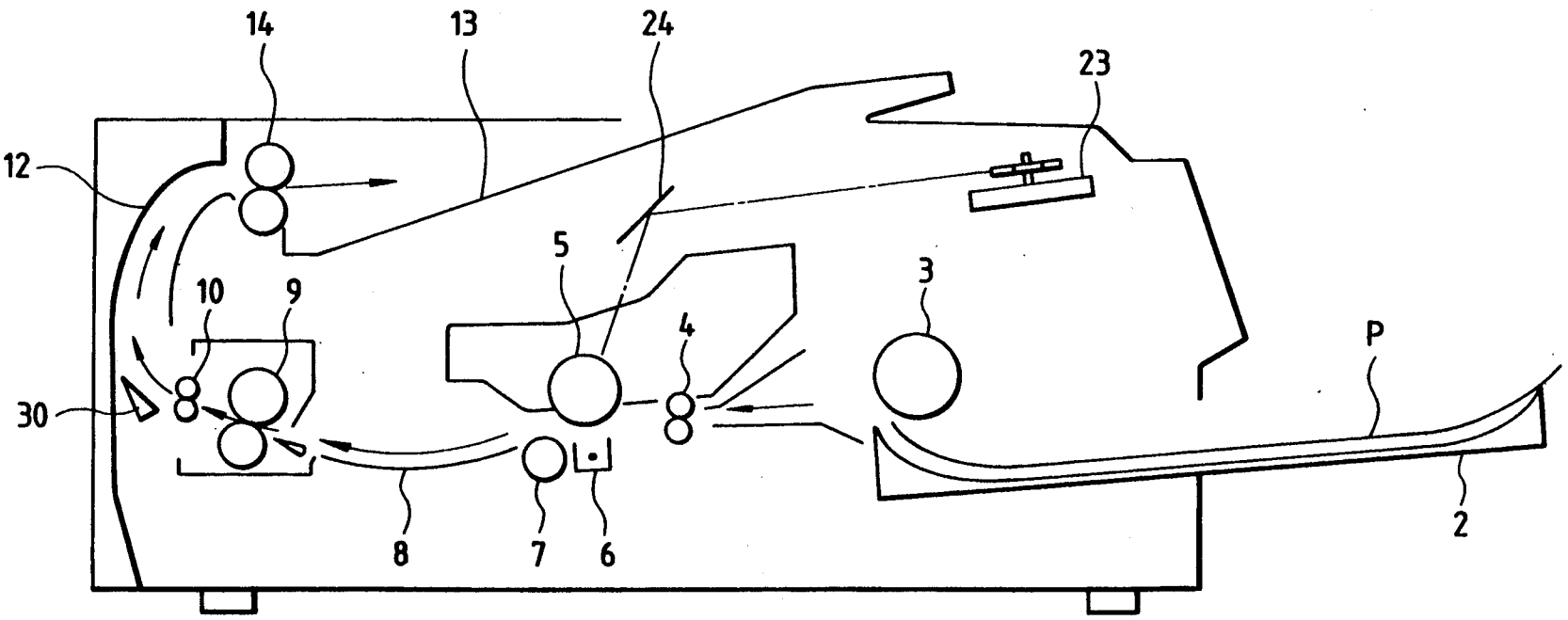
FIG. 8 is a side sectional view showing still another embodiment of the present invention.

Still another embodiment will be described below with reference to FIG. 8.

In this embodiment, an image is formed on one surface of a sheet member P. Therefore, an upward guide 30 is arranged at the downstream side of the convey rollers 10 in place of the flapper 11 of the embodiment shown in FIG. 2. In this embodiment, the sheet member P is registered in the widthwise direction in the cassette 2. The cassette 2 is curved along a convey direction of the sheet member P, thereby obtaining the same effect as described above.

In the cassette 2, lateral movement is attained by pressing a sheet member using the compression spring. When the number of stacked sheet members P is decreased, the sheet member P is curled in the widthwise direction. Thus, this embodiment is particularly effective when the number of sheet members P is small.

Still another embodiment will be described below with reference to FIGS. 9 to 15. In this embodiment, a lateral sheet size can be detected in accordance with a moving amount of a convey guide.

Figure 9:
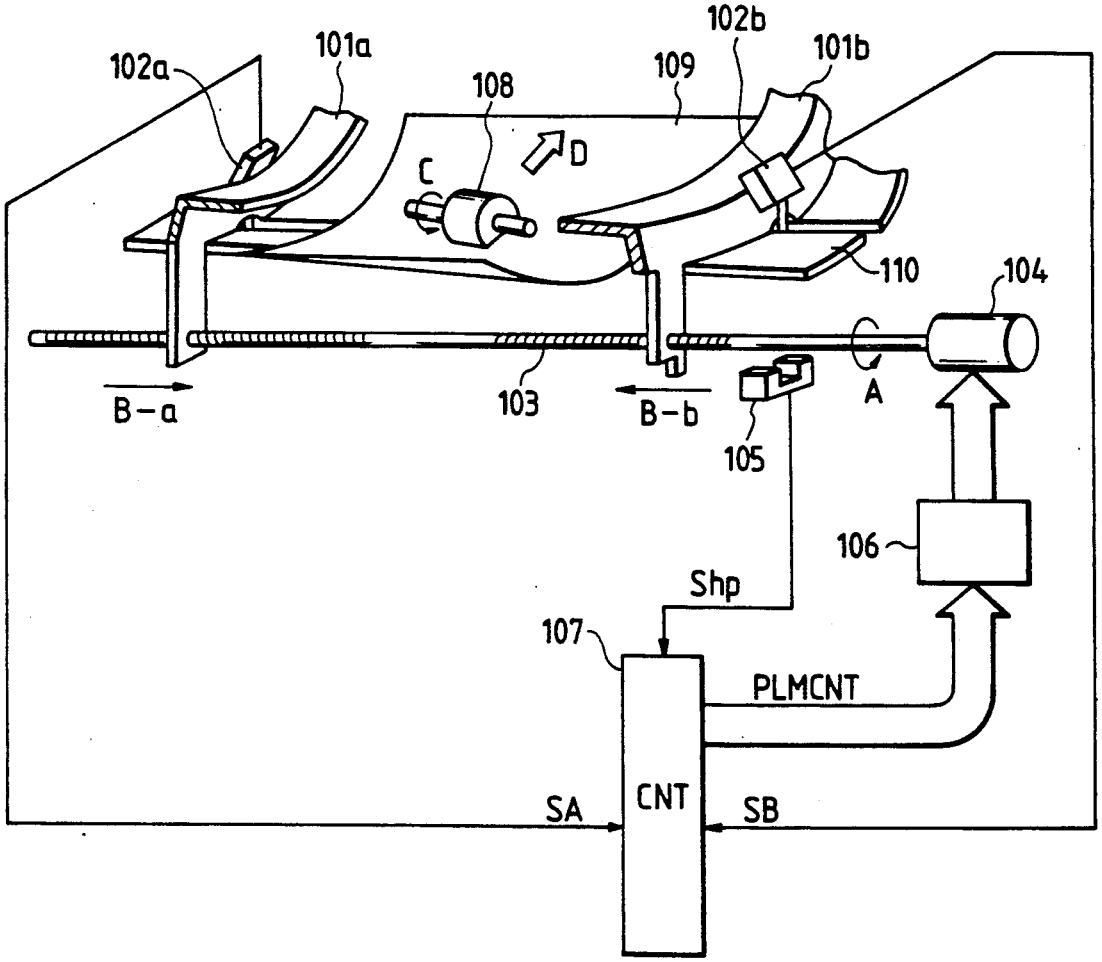
FIG. 9 is a schematic view showing an arrangement of a sheet supply unit comprising a sheet size detection means according to the present invention.

FIG. 9 shows an embodiment wherein the present invention is employed at a sheet supply port. In FIG. 9, a pair of convey guides 101*a* and 101*b* are arranged along a convey direction (a direction of an arrow D). Microswitches 102*a* and 102*b* serving as sheet side edge detection means are respectively fixed to the convey guides 101*a* and 101*b*. The convey guides 101*a* and 101*b* are connected to a screw shaft 103 which is rotated by a stepping motor 104.

When the screw shaft 103 is rotated in a direction of an arrow A in FIG. 9, the convey guides 101*a* and 101*b* are respectively moved in directions B-a and B-b in FIG. 9 along a base 110 which is curved in a convey direction. Note that a sheet is curved to enhance a resistance against a compression force.

A photointerrupter 105 detects passage of the convey guide 101*b*, and sets a home position. The convey guide 101*a* arranged on the screw shaft 103 is regulated by the photointerrupter 105. The stepping motor 104 is controlled by a control signal PLMCNT from a controller 107 through a drive circuit 106. A sheet 109 to be conveyed is conveyed by a D-shaped roller 108 in the direction of the arrow D in FIG. 9, and is fed to an image formation process means (not shown).

Figure 10:
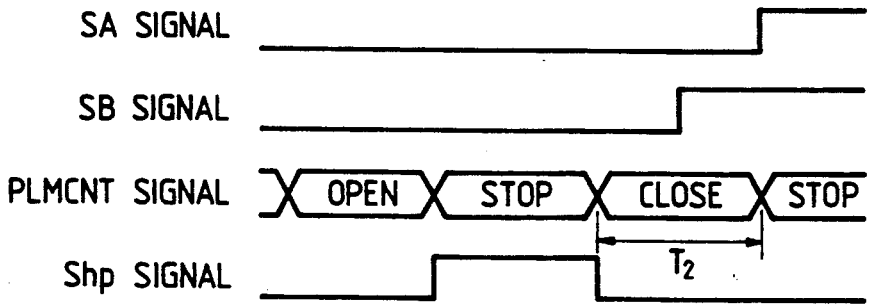
FIG. 10 is a timing chart of sheet size detection.
Figure 11:
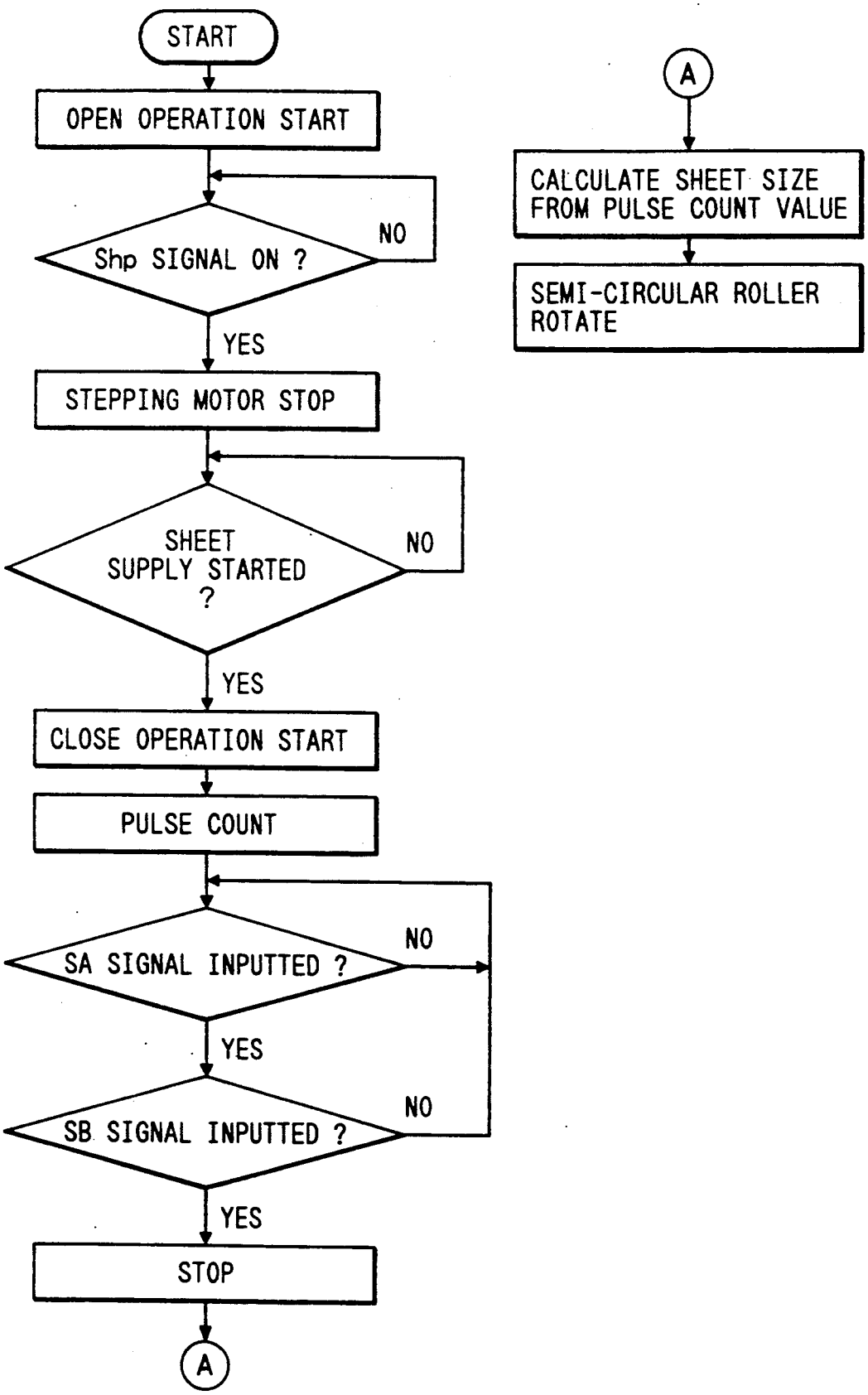
FIG. 11 is a flow chart of sheet size detection.

The operation of this embodiment will be described below with reference to the timing chart of FIG. 10, and the flow chart of FIG. 11.

Before a sheet is conveyed, the stepping motor 104 is rotated in a direction opposite to the direction of the arrow A in FIG. 9 to open the convey guides 101*a* and 101*b*. This is a preparation for the next size detection and lateral position registration (lateral registration of a sheet member, i.e., to regist the sheet member to a reference position). Rotation of the stepping motor 104 is controlled until the convey guide 101*b* passes by the photointerrupter 105 and an Shp signal is detected, thereby moving the guide 101*b* to the home position.

A close operation is started when the sheet (sheet member) 109 is inserted (or conveyed) to a position between the convey guides 101*a* and 101*b*. In this case, the semi-circular or D-shaped roller 108 is stopped (or stands by) at an angular position where the sheet 109 is released. The close operation is continued until the microswitches 102*a* and 102*b* detect side edges of the sheet 109. Since the base 110 is curved in the convey direction, the two side edges of the sheet 109 can be detected by the microswitches 102*a* and 102*b* without flexing the sheet 109. During this interval, the stepping motor 104 is rotated in the direction of the arrow A in FIG. 9, and the number of excitation pulses of the signal PLMCNT is counted until the two side edges of the sheet 109 are detected.

When the close operation is completed, a lateral sheet size is calculated on the basis of the pulse count value. If the lateral sheet size is represented by L, the pulse count is represented by n, a convey guide moving amount per pulse is represented by d, and a distance between the home position and the convey center is represented by $l_0$, the following relationship can be established:

$$L=2(l_0-nd)$$

Upon completion of the calculation, the D-shaped roller 108 is rotated in a direction of an arrow C in FIG. 9 to convey the sheet. In this case, the sheet member is registered to a correct position by the guides 101*a* and 101*b*.

In the above embodiment, registration is performed to have the lateral center as a sheet convey reference. However, the present invention is not limited to this. For example, if the convey guide 101*a* is held in a predetermined position, the same effect can be obtained when control is made with reference to an end in a lateral regist direction. The moving amounts of the convey guides are detected by counting the number of excitation pulses of the stepping motor. Alternatively, an electrical amount proportional to a moving amount may be directly measured using a variable resistor or the like.

Figure 12:
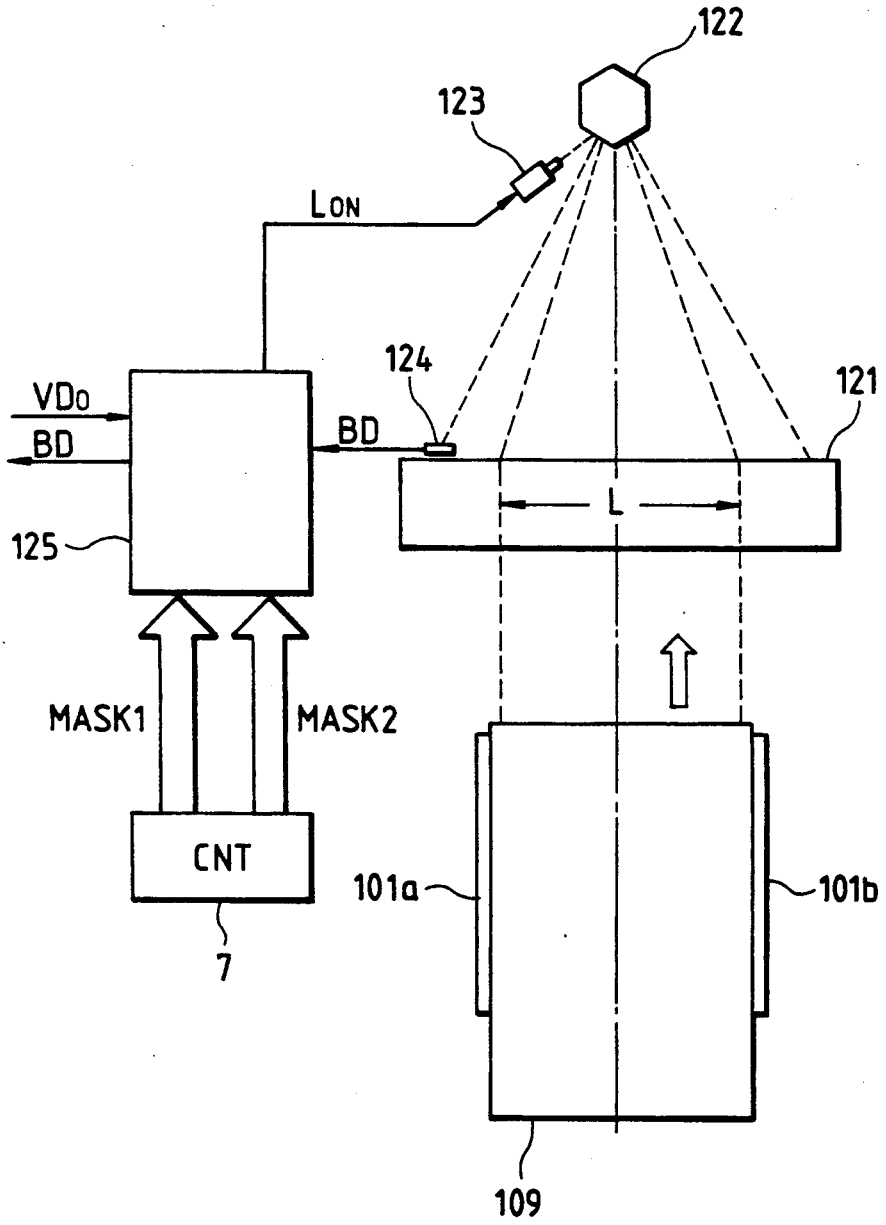
FIG. 12 is a schematic view showing an embodiment of the present invention in a laser beam printer.

FIG. 12 shows an embodiment of a laser beam printer which controls the width of an image to be formed in accordance with sheet size information obtained by the above embodiment. The same reference numerals in FIG. 12 denote the same parts as in FIG. 9.

A laser beam emitted from a laser diode 123 is scanned by a polygonal mirror 122 which is rotated at a predetermined rotational speed, thereby forming a latent image based on a modulation signal LON of the laser diode 123 on a surface of a photosensitive drum 121. The formed latent image is converted to a toner image by a developing means (not shown), and the toner image is transferred onto a conveyed sheet 109.

Figure 13:
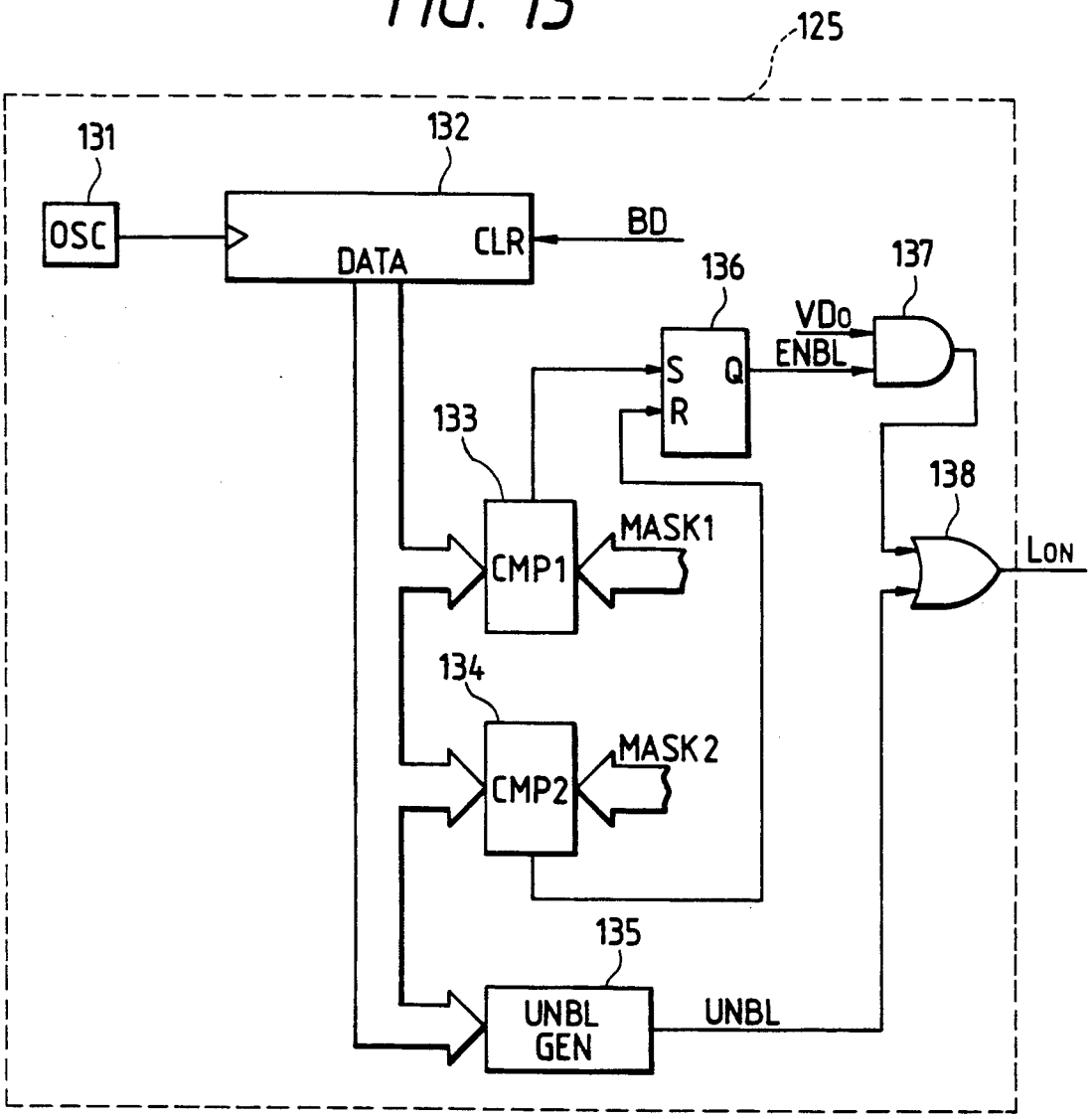
FIG. 13 is a block diagram of an image signal mask control circuit.

A beam detector 124 comprises a photoelectric transducer such as a photodiode, and outputs a beam detect signal BD as a reference timing signal for raster-scanning a laser beam. FIG. 13 shows a detailed arrangement of an image mask control circuit 125. An oscillator 131 supplies clock pulses to a counter circuit 132. The counter circuit 132 supplies a clock pulse count value to comparators 133 and 134, and an unblanking signal UNBL generator 135 for forcibly turning on the laser diode 123 to detect the beam detect signal BD, and clears the count value in response to the beam detect signal BD. The comparator 133 receives a first mask control value MASK1 from the controller 107. The comparator 134 receives a second mask control value MASK2 from the controller 107. The mask control values MASK1 and MASK2 are generated in accordance with the detected lateral sheet size L.

A flip-flop 136 sets an enable signal ENBL in response to a coincidence signal output from the first comparator upon comparison between the mask control value MASK1 and a count value from the counter circuit 132, and resets the enable signal in response to a coincidence signal output from the second comparator upon comparison between the mask control value MASK2 and the count value. The enable signal ENBL is input to an AND gate 137 together with a video signal VDO supplied from an external device. Therefore, the video signal VDO is gated by the enable signal ENBL.

The video signal VDO supplied through the AND gate 137 is synthesized with the unblanking signal UNBL by an OR gate 138, and the synthesized signal is sent as the modulation signal LON of the laser diode 123.

Figure 14:
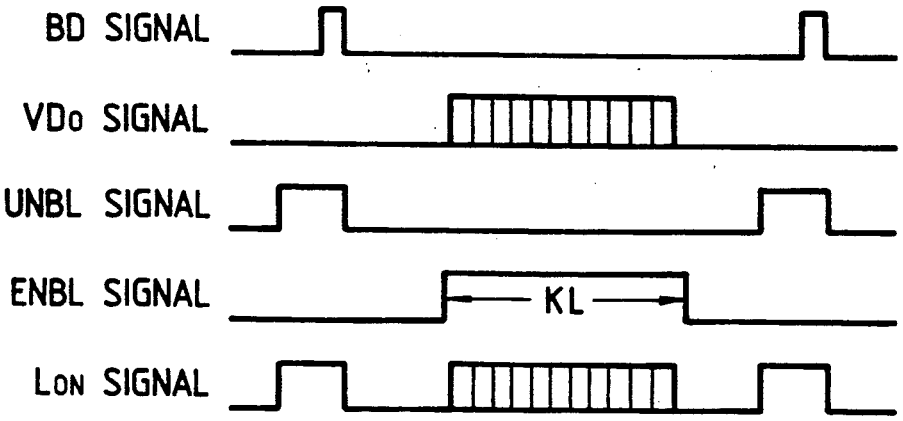
FIG. 14 is a timing chart in the image signal mask control circuit.

As shown in the timing chart of FIG. 14, the image mask control circuit 125 with the above arrangement generates the enable signal ENBL proportional to the lateral sheet size L, and hence, a latent image according to the sheet size L can be formed on the photosensitive drum 121 shown in FIG. 12.

In this embodiment, the width of an image to be formed is controlled in accordance with the detected lateral sheet width. For example, when a width of an image to be formed is given in advance, i.e., when an image width is designated by an external device such as a host computer in, e.g., a laser beam printer, the following control is executed to prevent an omission of image.

Figure 15:
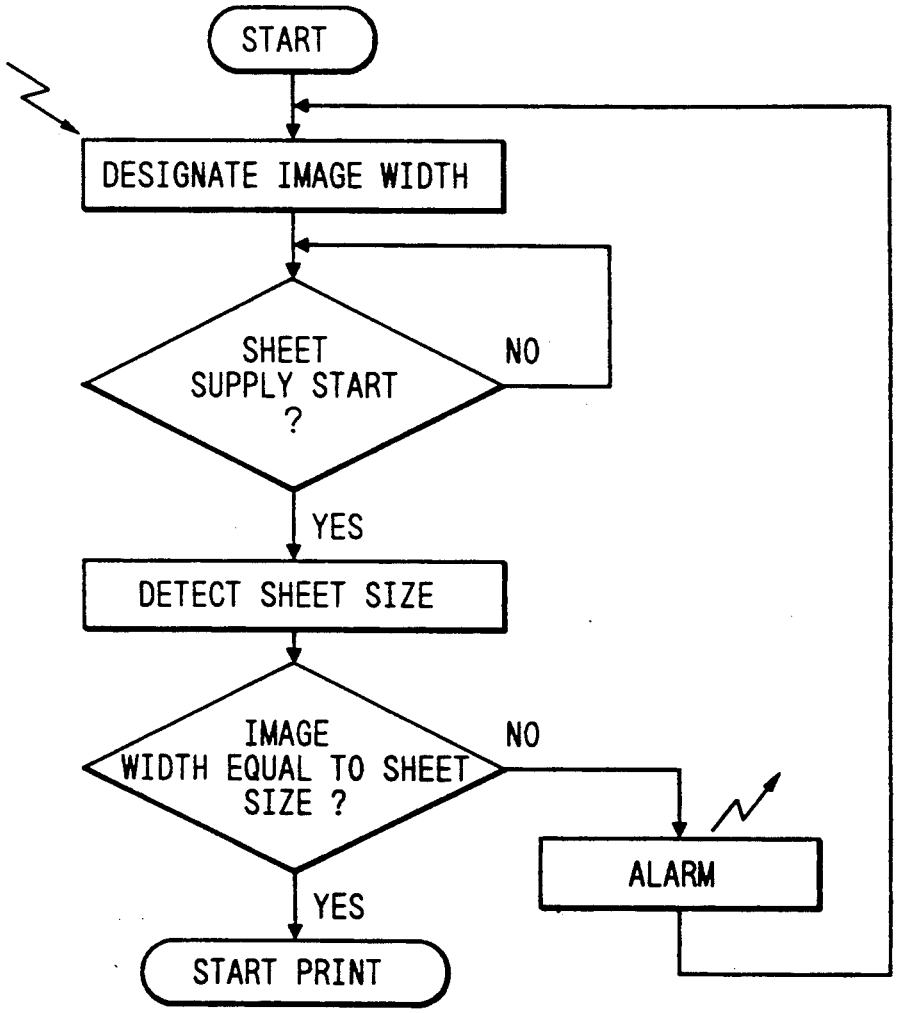
FIG. 15 is a flow chart for alarming noncoincidence of sheet sizes.

FIG. 15 is a flow chart of this control.

Image width information is received from the external device, and is stored. When a sheet supply operation is started, the lateral sheet size is detected by the operation described in the above embodiment. A lateral sheet size detection means may comprise a photosensor such as a photointerrupter in place of the microswitches described above. When the image width information does not coincide with the detected sheet size, an alarm indicating this is generated to the external device. When a coincidence is found, a printing operation is started.

As described above, according to the embodiment shown in FIGS. 9 to 15, since a pair of movable convey guides and sheet side edge detection means provided to the convey guides are arranged to detect a convey guide moving amount until the sheet side edge detection means detect the side edges of the sheet member, the following effects can be obtained:

(i) A lateral printing position can be kept constant;
(ii) Image omission can be prevented;
(iii) A developing agent can be efficiently consumed;
(iv) An electrophotographic process is not adversely influenced by an unnecessary developing agent; and
(v) Paper jam does not easily occur.

Figure 16:
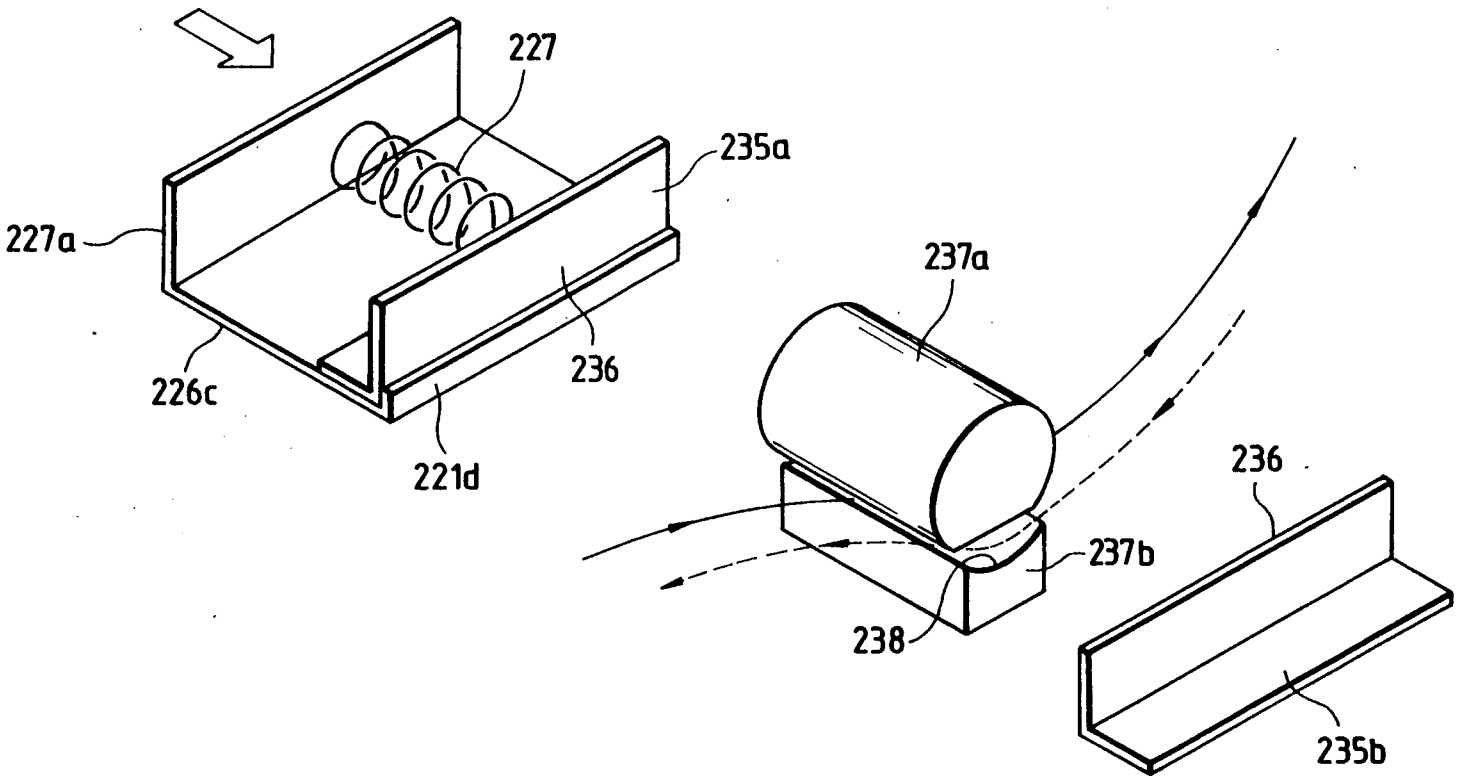
FIG. 16 is a perspective view showing a modification of the embodiment shown in FIG. 5.

In the above embodiment, as shown in FIG. 5A, a sheet member P is curved by the lateral regist plates 26*a* and 26*b*. Alternatively, as shown in FIG. 16, lateral regist plates 235*a* and 235*b* may comprise flat regist surfaces 236, and a member 237*b* for urging the sheet member P against a semi-circular roller 237*a* for switching back the sheet member P may be formed into a concave surface 238 substantially conforming to a cylindrical surface of the roller 237*a*. In addition, FIG. 16 illustrates a coil spring 227, a spring base 227*a*, a base plate 226*c*, and a stopper 221*d*, and operations of these members are the same as those of the arrangement shown in FIG. 5A.

In this manner, the sheet member P is conveyed in the normal/reverse direction by normal/reverse rotation of the roller 237*a*, and is formed into an upward concave surface. Thus, the sheet member P can be smoothly conveyed along the guide 22 continuous with the edge 25 shown in FIG. 4.

The present invention exemplifies the central reference, and may be similarly applied to a side-reference arrangement.

We claim:

1. An image forming apparatus having a convey path comprising lateral movement means for controlling a widthwise position of a sheet member to be conveyed, wherein said convey path comprising said lateral movement means is curved in a convey direction, driving means for retracting said lateral movement means out of an entry path for the sheet member when the sheet member is entering into said convey path, and then shifting said lateral movement means to be pressed onto a side surface of the sheet member; and rotating means disposed in said convey path, for being abutted onto the sheet member for feeding when the sheet member is entering into said convey path, and then being separated from the sheet member when said driving means shifts said lateral movement means.

2. An apparatus according to claim 1, wherein a guide plate forming said convey path is curved, and wherein after the sheet member is aligned or positioned by shift of said lateral movement means, said rotating means returns the sheet member to a direction from which it was entered by reverse rotation thereof.

3. An image forming apparatus having a convey path comprising lateral movement means for controlling a widthwise position of a sheet member to be conveyed, wherein said convey path comprising said lateral movement means is curved in a convey direction, driving means for retracting said lateral movement means out of an entry path for the sheet member when the sheet member is entering into said convey path, and then shifting said lateral movement means to be pressed onto a side surface of the sheet member; and rotating means disposed in said convey path, for being abutted onto the sheet member for feeding when the sheet member is entering into said convey path, and then being separated from the sheet member when said driving means shifts said lateral movement means, wherein a guide plate foreign said convey path is curved, and wherein after the sheet member is aligned or positioned by shift of said lateral movement means, said rotating means returns the sheet member to a direction from which it was entered by reverse rotation thereof, and wherein said guide plate is moved integrally with said lateral movement means.

4. An apparatus according to claim 3, wherein said lateral movement means is a side wall of said guide plate.

5. An apparatus according to claim 4, wherein said guide plate comprises a pair of right and left guide plates, said pair of right and left guide plates being simultaneously moved in a widthwise direction of the sheet member in cooperation with each other.

6. An apparatus according to claim 5, further comprising detection means for detecting that the sheet member is urged against the side wall.

7. An image forming apparatus comprising:

sheet member supply means;

an image forming unit for forming an image on a sheet member supplied from said sheet member supply means;

an exhaust path for exhausting the sheet member on which the image is formed by said image forming unit;

a reconvey path for guiding the sheet member on which the image is formed by said image forming unit to said image forming unit again;

flapper means for switching to guide the sheet member to said exhaust path or said reconvey path;

a switch back unit, arranged in said reconvey path, for reversing a convey direction of the sheet member;

a sheet path arranged in said switch back unit and curved in the convey direction of the sheet member; and lateral movement means, arranged in said switch back unit, for registering a widthwise position of the sheet member in said sheet path.

8. An apparatus according to claim 7, further comprising rotation means, arranged in said switch back unit, for switching back the sheet member, wherein a gap portion is formed in said rotation means so as not to disturb lateral movement of the sheet member.

9. An apparatus according to claim 8, wherein said rotation means comprises a circular roller portion, and a semi-circular roller portion.

10. An apparatus according to claim 8, wherein the widthwise position of the sheet member is registered at a transient state between normal and reverse movements of the sheet member by said switch back unit.

11. An apparatus according to claim 10, wherein said switch back unit generates a larger convey force when said back unit unloads the sheet member than that when said switch back unit loads the sheet member.

12. An apparatus according to claim 7, wherein a guide plate forming a convey path is curved.

13. An apparatus according to claim 12, wherein said guide plate is moved integrally with said lateral movement means.

14. An apparatus according to claim 11, wherein said lateral movement means is a side wall of said guide plate.

15. An apparatus according to claim 14, wherein said guide plate comprises a pair of right and left guide plates, said pair of right and left guide plates being simultaneously moved in a widthwise direction of the sheet member in cooperation with each other.

16. An apparatus according to claim 15, further comprising detection means for detecting that the sheet member is urged against the side wall.

17. An apparatus according to claim 15, wherein said pair of guide plate are located at positions separated by a distance larger than a width of the sheet member when the sheet member is loaded.

18. An image forming apparatus for performing image formation while conveying a sheet member, comprising:

a pair of convey regist guides arranged in a sheet convey path curved in a convey direction of the sheet member, and extending along the convey direction of the sheet member;

movement control means for moving said convey regist guides from predetermined positions in a direction perpendicular to the convey direction;

sheet member side edge detection means arranged on said pair of convey regist guides; and detection means for detecting a length of the sheet member in a direction perpendicular to the convey direction on the basis of a moving amount of said convey regist guides when said convey regist guides are moved and said sheet member side edge detection means detect side edges of the sheet member.

19. An apparatus according to claim 18, further comprising image mask control means for controlling a width of an image to be formed on the basis of a sheet member size detected by said detection means.

20. An apparatus according to claim 18, further comprising:

means for externally designating an image width;

comparison means for comparing the detected sheet member size and the input image width; and alarming means for, when the input image width is larger than the detected sheet member size, generating an external alarm.

* * * * *

UNITED STATES PATENT AND TRADEMARK OFFICE

CERTIFICATE OF CORRECTION

PATENT NO. : 5,091,754

DATED : February 25, 1992

INVENTOR(S) : MAKOTO ABE, ET AL.

It is certified that error appears in the above-identified patent and that said Letters Patent is hereby corrected as shown below:

COLUMN 3

Line 15, "26b," should read --26b.--

COLUMN 8

Line 20, "foreign" should read --forming--.

COLUMN 9

Line 17, "claim 11," should read --claim 13,--.

Signed and Sealed this

Fifteenth Day of June, 1993

Attest:

Michael K. Kirk

MICHAEL K. KIRK

Attesting Officer

Acting Commissioner of Patents and Trademarks